United States Patent [19]

Courtois et al.

[11] Patent Number: 4,726,562

[45] Date of Patent: Feb. 23, 1988

[54] APPARATUS FOR CASTING AN ANCHOR IN A CONCRETE UNIT

[75] Inventors: Peter D. Courtois, Centerville; Roy L. Edgar, Springboro; Arthur G. Mess, Jr., Centerville, all of Ohio

[73] Assignee: Dayton Superior Corporation, Miamisburg, Ohio

[21] Appl. No.: 889,060

[22] Filed: Jul. 22, 1986

[51] Int. Cl.[4] ..... E04G 17/00; B28B 7/16

[52] U.S. Cl. ..... 249/91; 52/125.4; 52/701; 249/94; 249/97; 249/177; 264/278

[58] Field of Search ..... 249/35, 40, 45, 46, 249/63, 86, 91, 93, 94, 96, 97, 95, 177, 184, 216, 217, 219 R; 52/125.4, 125.5, 701; 294/89, 90; 264/275, 278

[56] References Cited

U.S. PATENT DOCUMENTS

| | | | |
|---|---|---|---|
| 1,486,147 | 3/1924 | Kelly | 249/217 |
| 2,726,432 | 12/1955 | Lemma | 249/219 R |
| 3,605,361 | 9/1971 | Howlett et al. | 425/111 |
| 3,965,542 | 6/1976 | Gregory | 249/40 |
| 3,965,543 | 6/1976 | Connors | 249/40 |
| 4,000,591 | 1/1977 | Courtois | 52/125.4 |
| 4,221,357 | 9/1980 | Bowden et al. | 249/219 R |
| 4,296,909 | 10/1981 | Haeussler | 249/94 |
| 4,398,762 | 8/1983 | Haeussler et al. | 294/89 |
| 4,538,850 | 9/1985 | De Vito | 294/89 |
| 4,580,378 | 4/1986 | Kelly et al. | 52/125.5 |

OTHER PUBLICATIONS

Pre-Cast, Pre-Stress Concrete Handbook, published by Dayton Superior Corporation, 1983, p. 33.

*Primary Examiner*—Jay H. Woo
*Assistant Examiner*—James C. Housel
*Attorney, Agent, or Firm*—Biebel, French & Nauman

[57] ABSTRACT

An apparatus for casting an anchor in a concrete unit in which the head of the anchor is gripped by a plurality of resiliently-biased gripper elements pivotally attached to a cylindrical mandrel, the mandrel is drawn within the bore of a void former sleeve having a hemispherical outer end, and the sleeve is withdrawn within the channel of a support sleeve attached to associated formwork such that the hemispherical outer end protrudes from the formwork. After the concrete unit is cast, the void former sleeve is withdrawn from the unit so that the outer end leaves a hemispherical void in the unit and the mandrel is disengaged from the head of the anchor, leaving the head exposed within the void. The support sleeve includes a spring-loaded detent pin which is positioned to engage detent slots in the void former sleeve and a detent recess in the mandrel to hold the sleeve and mandrel in position during casting and to hold the sleeve in position as the anchor is attached to the mandrel.

18 Claims, 8 Drawing Figures

APPARATUS FOR CASTING AN ANCHOR IN A CONCRETE UNIT

BACKGROUND OF THE INVENTION

The present invention relates to apparatus and methods for casting anchors in concrete units and, more particularly, for apparatus and methods for casting anchors in conrete units such that the anchor head is recessed within a void formed in the cast unit.

Many buildings and retaining walls include in their structure large, precast concrete units of various shapes designed to facilitate their interlocking engagement when set into place. These precast concrete units may range in weight from several hundred pounds to several tons. In order to facilitate the handling of such concrete units, the units are cast with pickup bolts or anchors at predetermined locations. The anchors typically comprise a length of steel rod with a flared head and foot. The flared foot may be tied to an adjacent piece of reinforcing steel, and the flared head is positioned within a void or recess so that it is spaced from the adjacent outer surface of the unit.

A precast concrete unit having the aforementioned anchors can be picked up and handled relatively easily by attaching the anchors to the cable of a hoist. The cable may be attached to lifting eyes which comprises a notched ball shaped to fit within the recess and engage the anchor head, and a large eye which is connected to a hook or cable. A lifting eye of this type is shown in Haeussler et al. U.S. Pat. No. 4,398,762.

One device for casting an anchor in a concrete unit is shown in Haeussler U.S. Pat. No. 4,296,909, and includes a pair of quarter-spherical steel elements which meet to form an opening sized to receive the shank of the anchor, and include an interior cavity recess shaped to receive the anchor head. The spherical elements are pivotally attached to a bridge piece which in turn receives a threaded mounting rod.

An anchor is inserted between the spherical elements and the rod is bolted to the formwork. The pressure of the formwork against the spherical elements and the bridge piece maintains them in a coplanar relationship to each other while the concrete is cast and hardens. After the concrete has hardened, the formwork is separated from the cast unit, and the device is disengaged from the anchor head by rocking the rod back and forth, which alternately disengages each of the quarter-spherical elements.

In another type of apparatus for casting an anchor, a hemispherical steel recess plug is attached to the formwork and includes a cylindrical recess sized to receive the anchor head. A split rubber ring is placed about the shank of the anchor just below the head and is sized to seal the cylindrical recess to prevent the entry of concrete during the casting process. Once the concrete has hardened, the formwork is separated from the cast unit, and the recess plugs are then manually removed from the units.

In a variation of the aforementioned device, the recess plug is made of rubber and includes a cylindrical opening sized to receive the shank of the anchor. The cylindrical opening communicates with an interior chamber shaped to receive the anchor head. This recess plug is attached to the formwork and the anchor is forced through the resilient cylindrical opening of the recess plug.

A disadvantage with this particular device is that there is a likelihood that the rubber recess plugs may be damaged after repeated deformation resulting from the forced insertion of the anchor head through the cylindrical opening. There is also a possibility of concrete leakage into the interior chamber in the event that the opening is not sized properly.

A disadvantage with all of the aforementioned devices is that the attachment of the anchor to the device, and the subsequent removal of the device from the anchor cast into the unit, are manually intensive, requiring an undesirable number of manipulative steps. This requirement for several manipulative steps raises the overall cost of fabricating the precast concrete unit. Accordingly, there is a need for an apparatus and method for casting an anchor in a concrete unit which is reliable, which minimizes the leakage of concrete into the void formed about the anchor head, and which minimizes the number of manipulative steps required for attachment of the anchor to the device and the subsequent removal of the device from the anchor cast in the unit.

SUMMARY OF THE INVENTION

The present invention is an apparatus and method for casting an anchor in a concrete unit in which the anchor is readily attachable to the apparatus prior to casting and the apparatus is easily removed from the anchor head after the unit has been cast. Unlike prior art-devices, the apparatus is integral with the formwork of the precast unit, and need not be separated from the formwork prior to being separated from the cast unit. Accordingly, the step of reattaching the device to the formwork, required with prior art devices, is eliminated.

The apparatus includes a mandrel having a recess at its outer end surrounded by a plurality of gripper elements which are biased radially inwardly, a void former sleeve having a hemispherical outer end and a longitudinal bore receiving the mandrel, and a support sleeve having a longitudinal channel sized to receive the void former sleeve. The gripper elements are easily deflected radially outwardly from the mandrel in response to the pressure exerted to insert the anchor head into the recess. Once the anchor has entered the recess, the gripper elements pivot radially inwardly to engage the shank of the anchor and retain the head within the recess. The recess preferably includes a spring-loaded plunger which urges the anchor head against the gripper elements so that the anchor is maintained in a coaxial relationship with the mandrel.

The bore of the void former sleeve is sized such that the gripper elements are prevented from pivoting radially outwardly when the mandrel is displaced within the sleeve. This relationship prevents the anchor from being released from the apparatus until the apparatus is disengaged from the cost unit. In the preferred embodiment, a cam rod extends outwardly from the mandrel and is received within an elongated, longitudinally-extending slot in the void former sleeve. The slot acts as a cam surface and the ends of the slot define limits of travel for the mandrel relative to the void former sleeve.

Preferably, the outer limit of travel allows the mandrel to extend outwardly from the bore a sufficient amount to allow the gripper fingers to be pivoted outwardly to receive the anchor head. The inner limit of travel allows the mandrel to be withdrawn into the bore of the void former sleeve to a point in which the outer end of the mandrel forms a continuous surface with the outer end of the void former sleeve.

The support sleeve is adapted to be attached to the formwork for the precast unit and includes a spring-loaded detent pin at its end. The detent pin is positioned to extend through a detent slot formed in the void former sleeve and a detent recess formed in the mandrel when the mandrel and void former sleeve are positioned so that the mandrel is withdrawn into the void former sleeve and the void former sleeve is positioned such that the hemispherical outer end protrudes into the mold.

The support sleeve includes a retainer stud which engages a longitudinal groove in the former sleeve. The groove has closed ends and the engagement prevents the former sleeve from inadvertently falling into the support sleeve.

The method of the invention is initiated by attaching the end of an anchor to the mandrel by inserting the anchor head into the recess. The mandrel is then withdrawn into the void former sleeve so that the gripper elements are prevented from pivoting radially outwardly, thereby locking the anchor within the recess.

The void former sleeve can then be positioned within the support sleeve such that the hemispherical outer end protrudes from the formwork. The detent pin is then released to lock the void former sleeve and mandrel in position relative to the support sleeve. With the anchor and void former sleeve now in the proper position, the concrete casting process can be effected.

After the concrete has hardened, the detent pin is disengaged from the void former sleeve and mandrel, and the void former sleeve is displaced relative to the support sleeve away from the cast concrete unit. This action causes the mandrel to be withdrawn from the bore of the void former sleeve. Once the cam rod reaches the stop in the cam rod slot, the resulting force causes the anchor head to be withdrawn from the recess in the mandrel.

All of the principal components of the invention may be fabricated from steel or aluminum alloy, which provides a long useful life. The apparatus also may be assembled or disassembled easily for cleaning or repair.

Accordingly, it is an object of the present invention to provide an apparatus and method for casting an anchor in a concrete unit in which the anchor can be attached to or removed from the apparatus with relatively few manipulative steps; an apparatus in which the attachment and removal operations can be performed with a small likelihood of damage to the apparatus or the jamming of its components; and an apparatus which can be made of highly wear-resistant components which provide a long, trouble-free life.

Other objects and advantages of the invention will be apparent from the following description, the accompanying drawings, and the appended claims.

DETAILED DESCRIPTION OF THE PREFERRED EMBODIMENT

Figure 1:
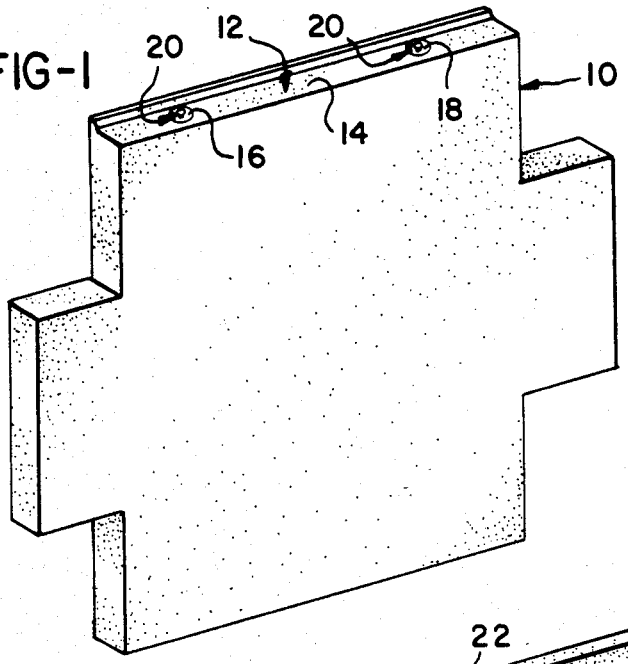
FIG. 1 is a perspective view of a precast concrete unit having a pair of anchors embedded in its upper surface.
Figure 2:
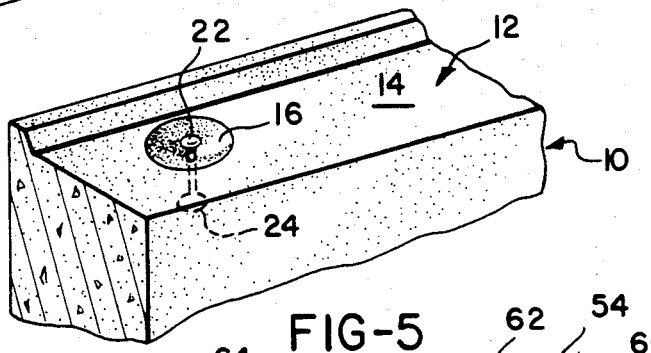
FIG. 2 is a detail of FIG. 1, showing a perspective view of one of the anchors.

As shown in FIGS. 1 and 2, a precast concrete unit, generally designated 10, is plate-shaped and includes an outer peripheral surface 12. The upper peripheral surface 14 includes two hemispherical recesses 16,18, each associated with an anchor 20. Each anchor 20 is made from a section of steel rod and includes a flared head 22 and foot 24. The head 22 protrudes from the bottoms of the recesses 16,18 so that the top portion of the head is slightly below the upper surface 14. The anchors 20 are centered within the recesses 16,18 and can be grasped by pickup devices such as that shown in Hacussler et al. U.S. Pat. No. 4,398,762, the disclosure of which is incorporated herein by reference.

Figure 3:
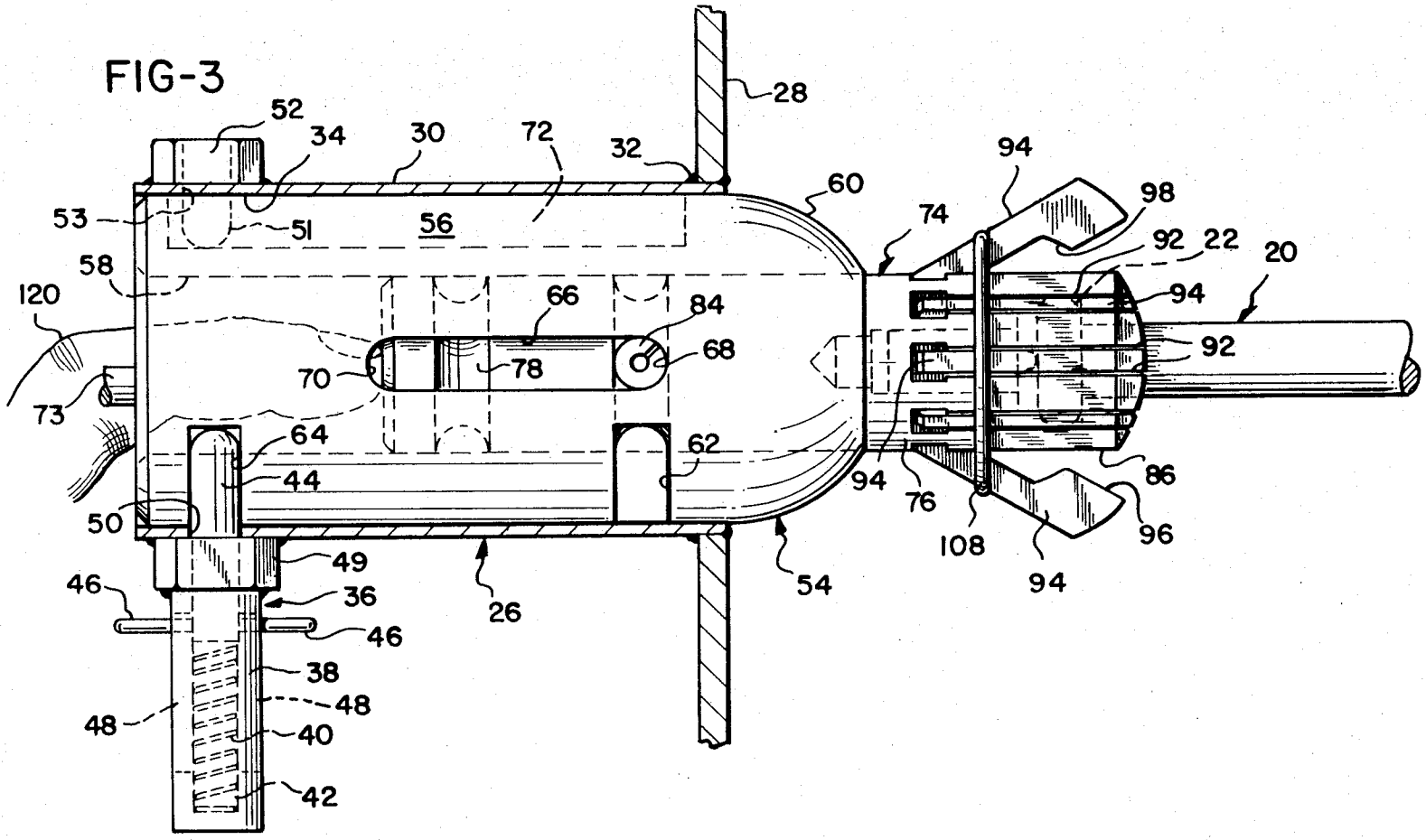
FIG. 3 is a side elevation of a preferred embodiment of the present invention, shown attached to formwork, and in which the support sleeve and formwork are in section.

Such concrete units 10 are cast within formwork which supports the apparatus of the present invention, generally designated 26, shown attached to a formwork wall 28 in FIG. 3. The apparatus 28 includes a cylindrical support sleeve 30 which is attached to the formwork wall 28 by weldments 32 and forms a central, longitudinal channel 34. Alternately, a threaded connection can also be made. A detent 36 is attached to the sleeve 30 adjacent to its inward end and includes a cylindrical barrel 38 which receives a coil spring 40 seated within a chamber 42 and urges against a detent pin 44, having a rounded tip.

The detent pin 44 also includes a pair of handles 46 which protrude outwardly from the pin and are displaceable along opposing slots 48 formed in the barrel 38. The barrel 38 is threaded into a nut 49 which, in turn, is welded to the outer surface of the sleeve 30. The pin 44 extends through an opening 50 in the sleeve so that the tip of the pin protrudes into the channel 34.

A retainer stud 51 is threaded into a nut 52 attached to the sleeve 30 opposite the detent 36. The stud 51 extends through a hole 53 in the sleeve 30 and into the channel 34.

Figure 4:
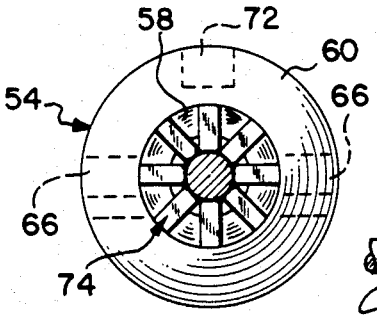
FIG. 4 is an end elevation of the void former sleeve and mandrel of the apparatus of FIG. 3, in which the mandrel is shown retaining an anchor, shown in section.
Figure 5:
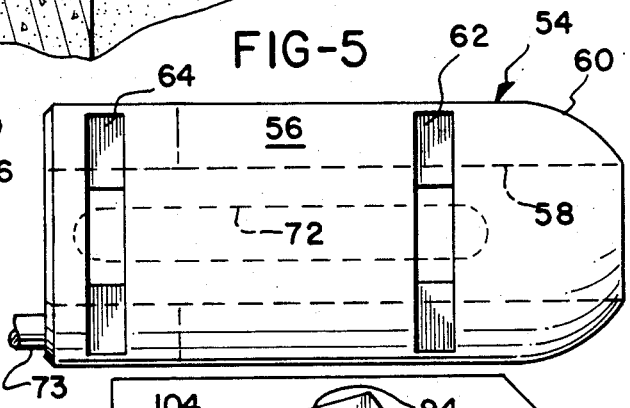
FIG. 5 is a side elevation of the void former sleeve of FIG. 3.

As shown in FIGS. 3, 4 and 5, a void former sleeve, generally designated 54, includes cylindrical body 56 having a central, longitudinal bore 58 extending therethrough. The void former sleeve 54 terminates in an outer end 60 having a truncated hemispherical shape. The body of the former sleeve 54 includes forward and rearward detent slots 62,64, respectively which open into the central bore 58.

The body 56 also includes a pair of opposing cam slots 66, each of which includes forward and rearward rounded surfaces 68, 70 respectively. The body 56 also includes an elongated groove 72 which extends parallel to the bore 58 and opposite the detent slots 62,64. The groove 72 receives the stud 51 and is closed ended, so that the engagement of the stud 51 with the groove 72 defines limits of forward and rearward travel of the former sleeve 54 within the channel 34. A handle 73 is threaded into the end of the body 56.

Figure 6:
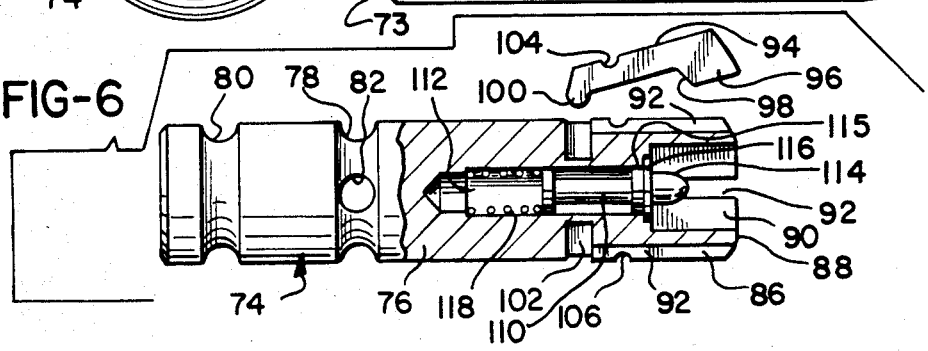
FIG. 6 is a side elevation of the mandrel of FIG. 3, in which a gripper element is shown exploded from the mandrel body.

As shown in FIGS. 3, 4, and 6, a mandrel, generally designated 74, includes an elongate, cylindrical body 76 having forward and rearward circumferential grooves 78,80 respectively. Groove 78 includes a diametrically extending hole 82 which receives a cam rod 84 in a press fit. The cam rod 84 extends outwardly from the mandrel body 76 and into the opposing cam slots 66 of the void former sleeve 56. The forward end 86 of the mandrel 74 terminates in an arcuate surface 88 having a recess 90. The outer end 86 includes a plurality of radially extending slots 92, each of which communicates with the recess 90 and receives a gripper element 94.

Each gripper element 94 includes an inwardly extending finger 96 which includes an interior gripping surface 98. The end of the gripper element 94 opposite the finger 96 includes a rounded portion 100 which is received within a recess 102 formed in the body 76. The outer edge of each gripper element includes a notch 104 which is aligned with corresponding notches 106 formed in the outer end 86 of the mandrel 74, together forming a circumferential groove.

As shown in FIG. 3, the circumferential groove seats an O-ring 108. The O-ring resiliently urges the gripper elements 94 to pivot radially inwardly so that the fingers 96 enter the recess 90. The O-ring 108 is positioned so that each gripper element 94 pivots about its rounded portion 100.

A spring-loaded plunger 110 (see FIG. 6) is mounted within a bore 112 formed in the base of the recess 90. The plunger 110 includes a bullet-nosed pin 114 having a flange 115 which is urged outwardly against a snap ring 116 by a helical extension spring 118, seated within the bore 112.

The operation of the apparatus 26 is as follows. In order to attach the anchor 20 to the mandrel 74, the mandrel is first displaced outwardly relative to the void former sleeve 54 by inserting one's finger 120 into the bore 58 and pushing the mandrel body 76 until the cam rod 84 engages the forward rounded edge 68, which acts as a stop for the forward travel of the mandrel 74. In this position, the portion of the mandrel 74 including the gripper elements 94 protrudes outwardly from the outer end 60 of the void former sleeve 54. The anchor head 22 is pressed against the outer surface 88 of the mandrel, which causes the gripper elements to be forced radially outwardly as shown in FIG. 3, which allows the anchor head to enter the recess 90.

Once the anchor head 22 is within the recess 90, the pin 114 urges the head outwardly so that the underside of the head 22 engages the interior gripping surfaces 98 of the gripper elements 94. The force exerted by the pin 114 is sufficient to maintain the shank of the pin 20 in coaxial alignment with the cylindrical body 76 of the mandrel 74, but is not sufficient to spread the gripper elements 94 radially outwardly.

Figure 7:
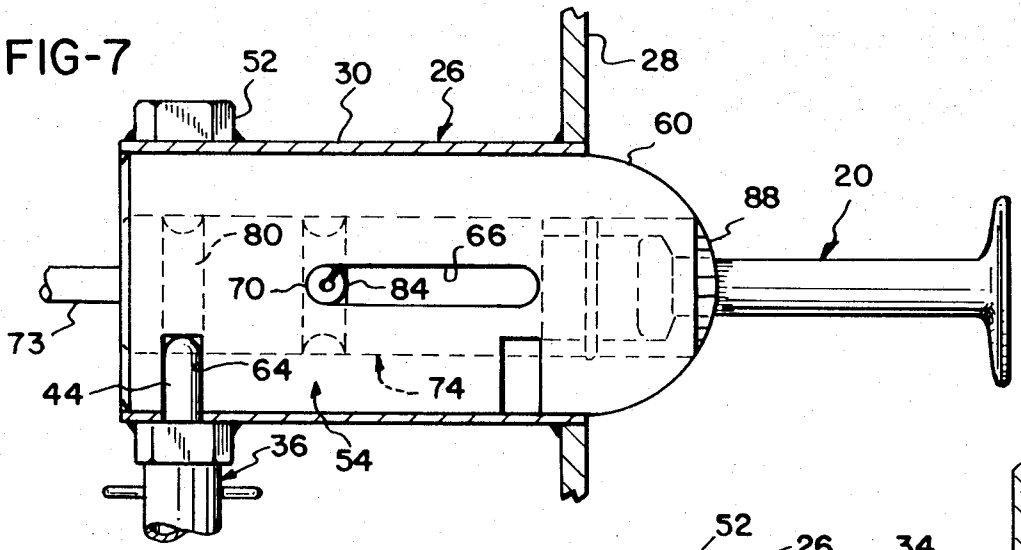
FIG. 7 is a side elevation of the apparatus of FIG. 3, in which the mandrel is shown withdrawn into the void former sleeve.

As shown in FIG. 7, in the next step of the method the mandrel 74 is withdrawn into the void former sleeve 54 until the cam rod 84 engages the rearward rounded edge 70 of the cam slot 66, which acts as a rearward limit of travel for the mandrel. At this point, the outer surface 88 of the mandrel 74 forms a continuous, rounded surface with the hemispherical outer end 60 of the void former sleeve 54.

The void former sleeve is now positioned within the support sleeve 30 such that the detent pin 44 extends through the rearward detent slot 64 and engages the rearward groove 80 of the mandrel 74. As a result, the mandrel 74 is locked within the void former sleeve 54, and the void former sleeve is locked in position relative to the support sleeve 30 so that only the hemispherical outer end 60 protrudes from the formwork wall 28 into the mold. It should be noted that the bore 58 is dimensioned such that, when the mandrel 74 is fully retracted within the bore, the gripper elements 94 are constrained from spreading radially outwardly and are held in an anchor-gripping position. With the apparatus 26 in position as shown in FIG. 7, the concrete unit can now be cast.

Figure 8:
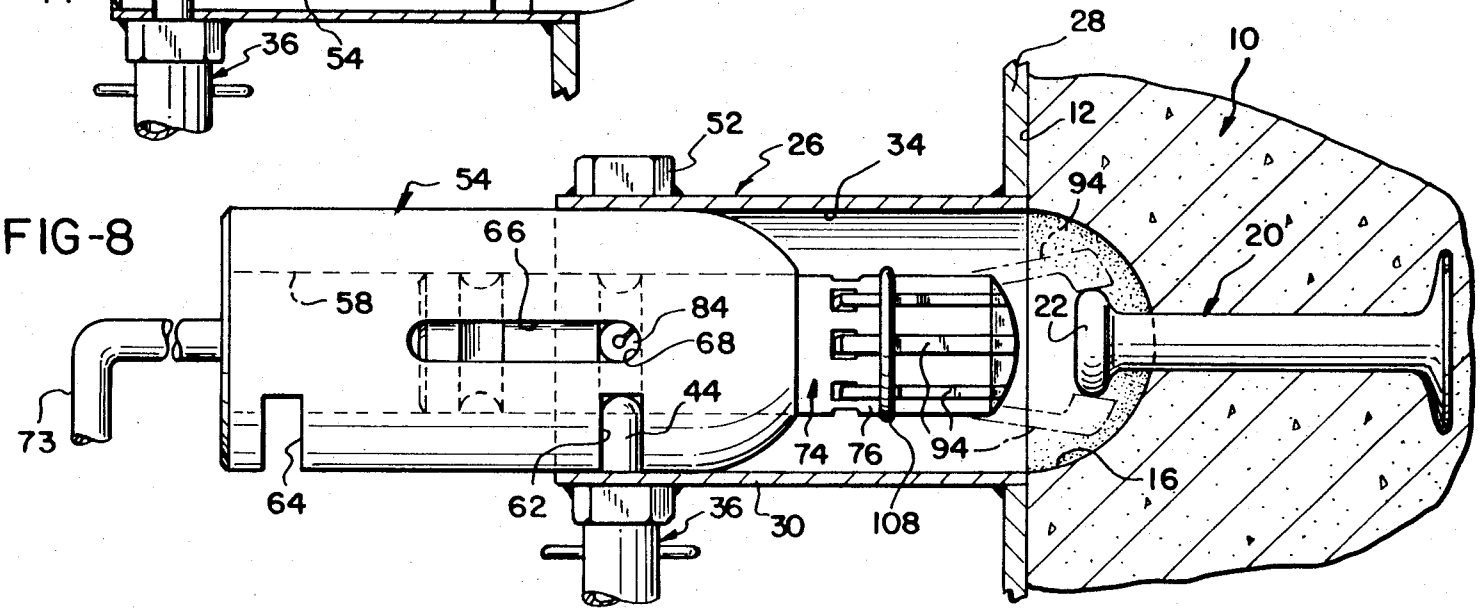
FIG. 8 is a side elevation of the apparatus of FIG. 3, showing the void former sleeve retracted from a cast concrete unit and the mandrel disengaged from the anchor head, and in which two gripper elements are shown splayed in phantom.

After the concrete has hardened, the apparatus 26 may now be disengaged from the concrete unit 10 and anchor 20, as shown in FIG. 8. The detent pin 44 is withdrawn from the slot 64 and groove 80, and the user grabs the handle 73 to draw the void former sleeve 54 away from the concrete unit 10 along the support sleeve 30. Since the mandrel 74 still engages the anchor head 22, the mandrel remains in position relative to the concrete unit 10 and slides along the bore 58 until the cam rod 84 encounters the end 68 of the cam slot 66. At this time, the continued displacement of the void former sleeve 54 away from the concrete unit 10 causes the anchor head to be released from the recess 90 (FIG. 6) which causes the gripper elements 94 to spread redially outwardly from the body 76.

The rearward movement of the void former sleeve 54 is stopped when the detent pin 44 engages the forward detent slot 62. The formwork walls 28 may now be removed from the outer surface 12 of the concrete unit 10, leaving the anchor heads 22 of the anchors 20 recessed within their respective hemispherical recesses as shown in FIGS. 2 and 8.

While the form of apparatus herein described constitutes a preferred embodiment of this invention, it is to be understood that the invention is not limited to this precise form of apparatus, and that changes may be made therein without departing from the scope of the invention.

What is claimed is:

1. An apparatus for casting an anchor in a concrete unit comprising:

means for gripping a head of an anchor, said gripping means including a mandrel and a plurality of gripper elements pivotally mounted on said mandrel;

means for forming a recess in a concrete unit, said forming means including a bore shaped to slidably receive said gripping means therein; and means for supporting said forming means and being attachable to formwork for a concrete unit, said supporting means including a channel shaped to slidably receive said forming and said gripping means therein, whereby withdrawal of said forming means into said channel effects separation of said forming means form a cast concrete unit, and release of an anchor by said gripping means.

2. The apparatus of claim 1 wherein said gripper elements are adapted to pivot from an anchor gripping position radially outwardly to an anchor release position.

3. The apparatus of claim 2 wherein said bore is shaped such that said gripper elements are constrained from pivoting to said anchor release position when a portion of said gripping means including said gripper elements is positioned within said bore, whereby said gripping means is locked about an anchor.

4. The apparatus of claim 2 wherein said gripping means includes resilient means for urging said gripper elements radially inwardly to said anchor gripping position.

5. The apparatus of claim 2 wherein each of said gripper elements includes an interior gripping surface for engaging a complementarily-shaped portion of a head of an anchor.

6. The apparatus of claim 1 wherein said mandrel includes a recess formed in an outer end thereof, and said gripper elements pivot into said recess when in said anchor gripping position and out of said recess when in said release position, said elements being shaped to form a hole, when in said gripping position, sized to receive a shank of an anchor therethrough such that a head of an anchor may be retained within said recess when said elements are in said gripping position.

7. The apparatus of claim 6 wherein said gripper elements include radially inwardly extending fingers which protrude into said recess when said gripper elements are in said anchor gripping position.

8. The apparatus of claim 7 wherein each of said fingers includes an interior gripping surface shaped to engage an underside of an anchor head.

9. The apparatus of claim 1 wherein said forming means includes an elongated body having a hemispherical outer end and said bore extends through said outer end and along said body.

10. The apparatus of claim 9 wherein said supporting means includes detent means for engaging said forming means.

11. The apparatus of claim 10 wherein said body includes means for receiving said detent means such that said body is fixable in a forming position, wherein said outer end protrudes from said supporting means, and in a retracted position, wherein said forming means is withdrawn into said supporting means.

12. The apparatus of claim 11 wherein said gripping means includes a recess for receiving said detent means when said forming means is in said forming position, and said gripping means is received within said bore in a locked position.

13. The apparatus of claim 9 wherein said gripping means includes a cam rod extending outwardly therefrom; and said forming means includes slot means for receiving said cam and defining forward and rearward limits of sliding movement of said gripping means relative to said forming means.

14. The apparatus of claim 1 wherein said forming means includes a longitudinally-extending, closed-ended slot and said supporting means includes a stud extending into said slot, thereby constraining sliding movement of said forming means relative to said support means so that said forming means is thereby prevented from sliding out of said support means.

15. The apparatus of claim 1 further comprising a recess formed in an outer end of said mandrel and shaped to receive a head of an anchor therein; and plunger means for urging an anchor head within said recess against said gripper elements.

16. The apparatus of claim 1 further comprising said supporting means including a cam rod slot; and said mandrel having a cam rod protruding into said cam rod slot, whereby said cam rod slot defines limits of travel of said gripping means relative to said supporting means.

17. An apparatus for casting an anchor in a concrete unit comprising:

an elongate, cylindrical mandrel having a cam rod protruding outwardly therefrom, a recess formed in an outer end of said mandrel, a plurality of gripper elements positioned peripherally about said recess, a resilient O-ring encircling said gripper elements such that said gripper elements are biased to pivot radially inwardly from an anchor release position to an anchor gripping position, said gripping elements each having a radially-inwardly directed finger which protudes into said recess when said gripper elements are in said anchor gripping position, said fingers each having an interior gripping surface shaped to engage a head of an anchor, said mandrel further including a spring-loaded plunger, positioned within said recess to urge a head of an anchor within said recess outwardly against said interior gripping surfaces and first and second detent grooves formed on said mandrel;

an elongate, cylindrical void former sleeve having a hemispherical outer end, a central, longitudinal bore extending therethrough shaped to slidably receive said mandrel such that said mandrel is positionable in an anchor locking position wherein said gripper elements are constrained from pivoting to said anchor release position when positioned within said bore, a longitudinally-extending cam rod slot receiving said cam rod and incuding forward and rearward stops defining limits of travel for said cam rod, and a detent slot communicating with said bore and said groove when said mandrel is withdrawn into said bore in said anchor locking position; and a cylindrical, elongate support sleeve adapted to be attached to formwork and including a channel for slidably receiving said former sleeve and a spring-loaded detent having a detent pin biased to extend radially inwardly to engage said first detent groove when said former sleeve is positioned relative to said support sleeve such that said outer end of said mandrel is protruding from said former sleeve, and to engage said second detent groove when said mandrel is withdrawn into said channel such that said gripper elements are constrained in said anchor locking position.

18. An apparatus for casting an anchor in a concrete unit comprising:

means for gripping a head of an anchor, said gripping means including a plurality of gripper elements constrained from pivoting to said anchor release position when a portion of said gripping means including said gripper elements is positioned within said bore, whereby said gripping means is locked about an anchor, each of said gripper elements including an interior gripping surface for engaging a complementarily-shaped portion of a head of an anchor, said gripping means further including plunger means for urging a head of an anchor against said gripping surface;

means for forming a recess on a concrete unit, said forming means including a bore shaped to slidably receive said gripping means therein; and means for supporting said forming means and being attachable to formwork for a concrete unit, said supporting means including a channel shaped to slidably receive said forming and said griping means therein, whereby withdrawal of said forming means into said channel effects separation of said forming means from a cast concrete unit, and release of an anchor by said gripping means.

* * * * *